United States Patent [19]

Hiraishi

[11] Patent Number: 4,467,338

[45] Date of Patent: Aug. 21, 1984

[54] HEAT-SENSITIVE RECORDING SHEET

[75] Inventor: Shigetoshi Hiraishi, Tokyo, Japan

[73] Assignee: Mitsubishi Paper Mills, Ltd., Tokyo, Japan

[21] Appl. No.: 507,456

[22] Filed: Jun. 24, 1983

[30] Foreign Application Priority Data

Jun. 29, 1982 [JP] Japan ..... 57-112106

[51] Int. Cl.[3] ..... B41M 5/18

[52] U.S. Cl. ..... 346/209; 346/216

[58] Field of Search ..... 282/27.5; 427/150–153; 428/320.4–320.8, 411, 488, 537, 913, 914

[56] References Cited

FOREIGN PATENT DOCUMENTS 57-41994 3/1982 Japan ..... 346/209

*Primary Examiner*—Bruce H. Hess

*Attorney, Agent, or Firm*—Cushman, Darby & Cushman

[57] ABSTRACT

In heat-sensitive recording sheets containing a colorless to light-colored dye precursor and a color developer which causes said dye precursor to develop a color by reacting with the precursor when heated, image stability can be improved without lowering sensitivities of heat-sensitive recording sheets by using, as a stabilizer, 1,1,3-tris(3-tertiarybutyl-4-hydroxy-6-methylphenyl)-butane.

6 Claims, No Drawings

HEAT-SENSITIVE RECORDING SHEET

BACKGROUND OF THE INVENTION

1. Field of the Invention

This invention relates to a heat-sensitive recording sheet and particularly to a heat-sensitive recording sheet having excellent image stability.

1. Description of the Prior Art

In recent years, the heat-sensitive recording method has come to possess various advantages such that it gives almost no impact and accordingly is noiseless, image records are obtained without development and fixation works and equipment maintenance is simple. Therefore, the method is widely used not only in various printers and telephone facsimile but also in many other areas. In the field of the telephone facsimile, the heat-sensitive system has been popularized sharply, which is being improved to a faster speed type for reduction of transmission cost. To respond to the speed-up of facsimile, an increased sensitivity has come to be required for heat-sensitive recording sheets. Further, retention of image records over a long period of time is strongly required and in this connection colored dyes must not cause fading and/or discoloration during retention of image records under moisture, heat and other conditions or through hand touch to image records.

Hitherto, as stabilizers for improving the retention of image records, phenol type oxidation inhibitors are described in Japanese Patent Application Kokai (Laid-open) No. 45747/1974, Japanese Patent Application Kokai (Laid-open) No. 18752/1979 and Japanese Patent Application Kokai (Laid-open) No. 83495/1982. However, none of these stabilizers can satisfactorily improve image stability without lowering sensitivities of heat-sensitive recording sheets.

SUMMARY OF THE INVENTION

The present invention made various invenstigations on stabilizers which can improve image stability without lowering sensitivities of highly heat-sensitive recording sheets containing a colorless to light-colored dye precursor and a color developer which causes said dye precursor to develop a color by reacting with the precursor when heated. As a result, by using, as a stabilizer, 1,1,3-tris(3-tertiarybutyl-4-hydroxy-6-methylphenyl)butane, they could develop a highly heat-sensitive recording sheet excellent in the retention of image records.

The stabilizer used in this invention is superior in the retention of image records to hitherto known bisphenol type stabilizers. It has also been found that this stabilizer is very effective also for prevention of image deterioration caused by frequent touch of hair liquid or oil-contaminated hands to image records, namely grease resistance.

DETAILED DESCRIPTION OF PREFERRED EMBODIMENTS

The stabilizer according to this invention is added preferably in the quantity of at least 3% by weight, more preferably 5 to 80% by weight and most preferably 20 to 80% by weight based on the quantity of a color developer. When the quantity of the stabilizer is less than 3% by weight, the effect is low. When the quantity is more than 80% by weight, the dilution effect increases and an economic disadvantage is incurred.

Main components used in this invention will be explained specifically. However, they are not restricted by the following substances.

(1) Dye Precursor

There can be used dye precursors which are employed generally in heat-sensitive sheets. They are, for example, Crystal Violet Lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-methyl-cyclohexylamino)-3-methyl-7-anilinofluoran, 3-piperidino-3-methyl-7-anilinofluoran, etc.

(2) Color Developer

As the color developer, there can be used acidic substances which are generally employed in heat-sensitive sheets. They include, for example, phenol, p-tert-butylphenol, p-phenyl-phenol, α-naphthol, p-hydroxyacetophenol, 2,2'-dihydroxyphenol, 4,4'-isopropylidenebis(2-tert-butylphenol), 4,4'-isopropylidenediphenol, 4,4'-cyclohexylidenediphenol, novolak type phenolic resins, benzoic acid, p-tert-butylbenzoic acid, p-oxybenzoic acid, benzyl p-oxybenzoate, methyl p-oxybenzoate, 3-benzyl-4-hydroxybenzoic acid, β-naphthoic acid, salicyclic acid, 3-tert-butylsalicyclic acid, 3-methyl-5-tert-butylsalicyclic acid, stearic acid, oxalic acid, maleic acid and the like. For sensitization of heat-sensitive sheets, 4-hydroxybenzoic acid esters, particularly benzyl 4-hydroxybenzoate and 4,4'-isopropylidenediphenol are used preferably. However, these color developers are inferior in image retention and therefore difficulties had existed in their use. However, their image retention could be improved greatly by the addition of the stabilizer in the invention.

(3) Binder

For example, starches, hydroxyethyl cellulose, methyl cellulose, polyvinyl alcohols, styrene-maleic anhydride copolymers, styrene-butadiene copolymers, polyacrylic amides, etc.

(4) Pigment

For example, diatomaceous earth, talc, kaolin, calcinated kaolin, calcium carbonate, magnesium carbonate, titanium oxide, zinc oxide silicon oxide, aluminum hydroxide, urea-formaldehyde resin, etc.

In addition to the above components, there may be added waxes such as stearamide, polyethylene, carnauba wax, paraffin wax, castor wax, oxidized paraffin, oxidized polyethylene, zinc stearate, calcium stearate and the like in the form of dispersion or emulsion.

Further, various other auxiliaries may be added. For example, there may be mentioned dispersants such as sodium dioctylsulfosuccinate and the like, ultraviolet light absorbers of benzophenone type, benzotriazole type and the like, defoamants, fluorescent dyes, coloring dyes and so forth. Of course, other substances may be mentioned as auxiliaries.

As the substrate used in the heat-sensitive recording sheet according to this invention, papers are used mainly. However, unwoven fabrics, plastic films, synthetic papers, metal foils, etc. as well as their composite sheets can also be used optionally.

Hereinunder, this invention will be explained specifically by referring to Examples. Parts and % in the following refer to parts by weight and % by weight, respectively.

EXAMPLE 1

(1) Dispersion A (dispersion of a dye precursor)

150 Parts of 3-diethylamino-6-methyl-7-anilinofluoran was ground for 48 hr in a ball mill together with 18 parts of an aqueous solution containing 25% of a sodium salt of a styrene-maleic acid copolymer and 332 parts of water, whereby Dispersion A was obtained.

(2) Dispersion B (dispersion of a color developer and a stabilizer)

150 Parts of benzyl 4-hydroxybenzoate and 60 parts of 1,1,3-tris(3-tert-butyl-4-hydroxy-6-methylphenyl)butane were ground for 48 hr in a ball mill together with 100 parts of 10% aqueous PVA solution and 390 parts of water, whereby Dispersion B was obtained.

(3) Formation of a heat-sensitive recording layer

67 Parts of Dispersion A, 234 parts of Dispersion B, 50 parts of calcium carbonate, 230 parts of 15% aqueous PVA solution and 120 parts of water were mixed and stirred. The resulting heat-sensitive coating color was coated on a base paper of 50 g/m$^2$ so that the coated quantity of the dye precursor became 0.6 g/m$^2$. After drying, the coated paper was subjected to super calendering to obtain a heat-sensitive recording sheet.

COMPARATIVE EXAMPLE 1

A heat-sensitive recording sheet was obtained in the same manner as in Example 1, except that, in preparation of Dispersion B, 1,1,3-tris(3-tert-butyl-4-hydroxy-6-methylphenyl)butane was replaced by 4,4'-butylidenebis(6-tert-butyl-m-cresol).

COMPARATIVE EXAMPLE 2

A heat-sensitive recording sheet was obtained in the same manner as in Example 1, except that, in preparation of Dispersion B, 1,1,3-tris(3-tert-butyl-4-hydroxy-6-methylphenyl)butane was not used.

EXAMPLE 2

(1) As a dispersion of a dye precursor was used Dispersion A of Example 1.

(2) Dispersion C (dispersion of a color developer and a stabilizer)

150 Parts of 4,4'-isopropylidenediphenol and 60 parts of 1,1,3-tris(3-tert-butyl-4-hydroxy-6-methylphenyl)butane were ground for 48 hr in a ball mill together with 100 parts of 10% aqueous PVA solution and 390 parts of water, whereby a dispersion was obtained.

(3) Formation of a heat-sensitive recording layer

67 Parts of Dispersion A, 234 parts of Dispersion C, 50 parts of calcium carbonate, 67 parts of 30% N-methylolstearamide dispersion, 267 parts of 15% aqueous PVA solution and 116 parts of water were mixed and stirred. The resulting heat-sensitive coating color was coated on a base paper of 50 g/m$^2$ so that the coated quantity of the dye precursor became 0.6 g/m$^2$. After drying, the coated paper was subjected to super calendering to obtain a heat-sensitive recording sheet.

COMPARATIVE EXAMPLE 3

A heat-sensitive recording sheet was obtained in the same manner as in Example 2, except that, in preparation of Dispersion C, 1,1,3-tris(3-tert-butyl-4-hydroxy-6-methylphenyl)butane was replaced by 4,4'-butylidenebis(6-tert-butyl-m-cresol).

COMPARATIVE EXAMPLE 4

A heat-sensitive recording sheet was obtained in the same manner as in Example 2, except that, in preparation of Dispersion C, 1,1,3-tris(3-tert-butyl-4-hydroxy-6-methylphenyl)butane was not used.

PERFORMANCE TEST 1

Recordings were made for each heat-sensitive recording sheet of Examples 1 and 2 and Comparative Examples 1 to 4 by the use of a heat-sensitive facsimile (Fujitsu Facom Fax 621 C). Then, each sheet was subjected to the following retention tests. The results were shown in Table 1. Densities of image records were measured by the use of a Macbeth densitometer.

a. Image density b. Heat resistance test

Test for the percentage of image retained when an image developed has been retained for 24 hr at 60° C.

$$\text{Percentage of image retained (\%)} = \frac{\text{image density after test}}{\text{image density before test}} \times 100$$

c. Moisture and heat resistance test

Test for the percentage of image retained when an image developed has been retained for 24 hr under a condition of 40° C. and 90% R.H.

d. Grease resistance test

A thin layer of castor oil was formed on an image record by the use of a felt pen filled with castor oil. Then, the castor oil-coated image was retained for 24 hr at 60° C. and the extent of deterioration of the image was observed. When the image disappeared completely, the result was rated with a mark X. When the image remained slightly, the result was rates with a mark Δ. When the image remained, the result was rated with a mark o.

TABLE 1

| | Image density (Test a) | Heat resistance (Test b) | Moisture and heat resistance (Test c), 24 hr | Grease resistance (Test d) |
|---|---|---|---|---|
| Example 1 | 1.33 | 99.2% | 100.0% | o |
| Comparative Example 1 | 1.33 | 93.1% | 93.3% | Δ |
| Comparative Example 2 | 1.34 | 80.5% | 91.9% | x |
| Example 2 | 1.09 | 93.7% | 99.1% | Δ |
| Comparative Example 3 | 1.08 | 88.9% | 93.4% | x |
| Comparative Example 4 | 1.09 | 84.5% | 92.7% | x |

EXAMPLE 3

(1) Dispersion D (dispersion of a dye precursor)

150 Parts of 3-(N-methylcyclohexylamino)-6-methyl-7-anilinofluoran was ground for 48 hr in a ball mill together with 18 parts of an aqueous solution containing 25% of a sodium salt of a styrene-maleic anhydride copolymer and 332 parts of water, whereby Dispersion D was obtained.

(2) Dispersion E (dispersion of a color developer)

150 Parts of benzyl 4-hydroxybenzoate was ground for 48 hr in a ball mill together with 75 parts of 10% aqueous PVA solution and 275 parts of water, whereby Dispersion E was obtained.

(3) Dispersion F (dispersion of a stabilizer)

150 Parts of 1,1,3-tris(3-tert-butyl-4-hydroxy-6-methylphenyl)butane was ground for 48 hr in a ball mill together with 75 parts of 10% aqueous PVA solution and 275 parts of water, whereby Dispersion F was prepared.

(4) Formation of a heat-sensitive recording layer

67 Parts of Dispersion D, 133 parts of Dispersion E, 4 parts of Dispersion F, 50 parts of calcium carbonate, 300 parts of 10% aqueous PVA solution, 67 parts of a dispersion containing 30% of zinc stearate and 185 parts of water were mixed. The resulting heat-sensitive coating color was coated on a base paper of 50 g/m$^2$ so that the coated quantity of the dye precursor became 0.6 g/m$^2$. After drying, the coated paper was subjected to super calendering to obtain a heat-sensitive recording sheet.

EXAMPLES 4 TO 10

Heat-sensitive recording sheets were prepared in the same manner as in Example 3, except that, in preparation of the heat-sensitive coating color of Example 3, Dispersion F was used in quantities of 5 parts, 6.7 parts, 26.7 parts, 66.7 parts, 106.7 parts, 120 parts and 133 parts, respectively.

COMPARATIVE EXAMPLE 5

A heat-sensitive recording sheet was prepared in the same manner as in Example 3, except that, in preparation of the heat-sensitive coating color of Example 3, the Dispersion F was not used.

EXAMPLE 11

(1) Dispersion G (dispersion of a color developer)

150 Parts of 4,4'-isopropylidenediphenol was ground for 48 hr in a ball mill together with 75 parts of 10% aqueous PVA solution and 275 parts of water, whereby Dispersion G was prepared.

(2) Formation of a heat-sensitive recording layer

67 Parts of Dispersion D of Example 3, 4 parts of Dispersion F of Example 3, 50 parts of calcium carbonate, 300 parts of 10% aqueous PVA solution, 67 parts of a dispersion containing 30% of zinc stearate were mixed with 133 parts of Dispersion G, 50 parts of a dispersion containing 20% of stearamide, 185 parts of water. The resulting heat-sensitive coating color was coated on a base paper of 50 g/m$^2$ so that the coated quantity of the dye precursor became 0.6 g/m$^2$. After drying, the coated paper was subjected to super calendering, whereby a heat-sensitive recording sheet was prepared.

EXAMPLES 12 TO 18

Heat-sensitive recording sheets were prepared in the same manner as in Example 11, except that, in preparation of the heat-sensitive coating color of Example 11, Dispersion F was used in quantities of 5 parts, 6.7 parts, 26.7 parts, 66.7 parts, 106.7 parts, 120 parts and 133 parts, respectively.

COMPARATIVE EXAMPLE 6

A heat-sensitive recording sheet was prepared in the same manner as in Example 11, except that, in preparation of the heat-sensitive coating color of Example 11, Dispersion F was not used.

PERFORMANCE TEST 2

Recordings were made for each heat-sensitive recording sheet of Examples 3 to 18 and Comparative Examples 5 and 6 by the use of a facsimile tester manufactured by Matsushita Electronic Components Co., Ltd. under a condition of 16.00 V and 2.0 msec pulse width. Similarly to Performance Test 1, image density, heat-resistance and moisture and heat-resistance were tested. The results were shown in Tables 2 and 3.

TABLE 2

| | Proportion of stabilizer to color developer | Image density (Test a) | Heat resistance (Test b) | Moisture and heat resistance (Test c), 24 hr |
|---|---|---|---|---|
| Comparative Example 5 | 0% | 1.19 | 80.2% | 88.5% |
| Example 3 | 3 | 1.19 | 82.6 | 90.2 |
| Example 4 | 4 | 1.19 | 82.8 | 91.5 |
| Example 5 | 5 | 1.20 | 90.6 | 95.2 |
| Example 6 | 20 | 1.20 | 93.9 | 97.4 |
| Example 7 | 50 | 1.19 | 100 | 98.1 |
| Example 8 | 80 | 1.19 | 100 | 100 |
| Example 9 | 90 | 1.17 | 100 | 100 |
| Example 10 | 100 | 1.16 | 100 | 100 |

TABLE 3

| | Proportion of stabilizer to color developer | Image density (Test a) | Heat resistance (Test b) | Moisture and heat resistance (Test c) | |
|---|---|---|---|---|---|
| | | | | 24 hr | 72 hr |
| Comparative Example 6 | 0% | 0.91 | 88.1% | 98.2% | 90.4% |
| Example 11 | 3 | 0.91 | 91.3 | 99.7 | 92.9 |
| Example 12 | 4 | 0.92 | 92.4 | 100 | 93.2 |
| Example 13 | 5 | 0.92 | 95.0 | 100 | 94.4 |
| Example 14 | 20 | 0.92 | 97.1 | 100 | 98.8 |
| Example 15 | 50 | 0.92 | 100 | 100 | 99.0 |
| Example 16 | 80 | 0.91 | 100 | 100 | 99.0 |
| Example 17 | 90 | 0.87 | 100 | 100 | 100 |
| Example 18 | 100 | 0.84 | 100 | 100 | 100 |

As is obvious from Tables 1 to 3, the retention of image records can be improved without lowering sensitivities of heat-sensitive recording sheets by the addition of the stabilizer of this invention.

What is claimed is:

1. A heat-sensitive recording sheet comprising a heat-sensitive recording layer containing a colorless to light-colored dye precursor and a color developer which causes said dye precursor to develop a color by reacting with the precursor when heated, characterized in that the heat-sensitive recording layer further contains as a stabilizer, 1,1,3-tris(3-tertiarybutyl-4-hydroxy-6-methylphenyl)butane.

2. A heat-sensitive recording sheet according to claim 1, wherein the quantity of 1,1,3-tris(3-tertiarybutyl-4-hydroxy-6-methylphenyl)butane is at least 3% by weight based on the quantity of the color developer.

3. A heat-sensitive recording sheet according to claim 2, wherein the quantity of 1,1,3-tris(3-tertiarybutyl-4-hydroxy-6-methylphenyl)butane is 5 to 80% by weight based on the quantity of the color developer.

4. A heat-sensitive recording sheet according to claim 3, wherein the quantity of 1,1,3-tris(3-tertiarybutyl-4-hydroxy-6-methylphenyl)butane is 20 to 80% by weight based on the quantity of the color developer.

5. A heat-sensitive recording sheet according to claim 1 wherein the color developer is benzyl 4-hydroxybenzoate.

6. A heat-sensitive recording sheet according to claim 1, wherein the color developer is 4,4'-isopropylidenediphenol.

* * * * *